US009632466B2

(12) United States Patent
Watatani

(10) Patent No.: US 9,632,466 B2
(45) Date of Patent: Apr. 25, 2017

(54) FIXING DEVICE AND IMAGE FORMING APPARATUS

(71) Applicant: KYOCERA Document Solutions Inc., Osaka (JP)

(72) Inventor: Tomohiro Watatani, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/176,414

(22) Filed: Jun. 8, 2016

(65) Prior Publication Data

US 2016/0378030 A1 Dec. 29, 2016

(30) Foreign Application Priority Data

Jun. 24, 2015 (JP) ..... 2015-1 26614

(51) Int. Cl.
*G03G 15/20* (2006.01)
*G03G 21/20* (2006.01)

(52) U.S. Cl.
CPC ..... *G03G 15/2053* (2013.01); *G03G 21/206* (2013.01)

(58) Field of Classification Search
CPC ..... G03G 15/2053; G03G 21/206
USPC ..... 399/328
See application file for complete search history.

(56) References Cited

U.S. PATENT DOCUMENTS

2015/0093161 A1* 4/2015 Takeuchi ..... G03G 15/2053 399/328

FOREIGN PATENT DOCUMENTS

JP 2007-293217 A 11/2007

* cited by examiner

*Primary Examiner* — Hoang Ngo
(74) *Attorney, Agent, or Firm* — Studebaker & Brackett PC

(57) ABSTRACT

A fixing device includes a casing, a fixing roller, a pressure roller, a heat source, a sensor, and a duct. The fixing roller is disposed in the casing. The pressure roller forms a fixing nip region in cooperation with the fixing roller. The fixing heat source heats the fixing roller. The sensor detects whether or not a recording medium is present in the fixing nip region. The duct is disposed on the casing. One end part of opposite end parts of the heat source protrudes out of the casing. The duct covers the one end part of the heat source and exhausts heat generated from the one end part of the heat source in a direction away from the sensor.

11 Claims, 9 Drawing Sheets

FIXING DEVICE AND IMAGE FORMING APPARATUS

INCORPORATION BY REFERENCE

The present application claims priority under 35 U.S.C. §119 to Japanese Patent Application No. 2015-126614, filed on Jun. 24, 2015. The contents of this application are incorporated herein by reference in their entirety.

BACKGROUND

The present disclosure relates to a fixing device and an image forming apparatus.

An image forming apparatus forms an image on paper with toner. The image forming apparatus includes a fixing device. The fixing device fixes a toner image to the paper. A fixing device such as above includes a fixing roller, a pressure roller, and a heat source for fixing. A fixing nip region is formed between the fixing roller and the pressure roller. The heat source for fixing heats the fixing roller. The fixing device applies heat and pressure to the paper by allowing the paper to pass through the fixing nip region. Through the above, the toner image on the paper is fixed to the paper.

The fixing device further includes an intra-fixing device jam sensor. The intra-fixing device jam sensor detects a paper jam in the fixing nip region. The intra-fixing device jam sensor includes a swing mechanism and a detection section. The swing mechanism includes a swing portion, a transmission portion, and an operation portion. The swing portion is disposed in the vicinity of an exit of the fixing nip region. The swing portion is caused to swing by the paper passing through the fixing nip region. The operation portion is disposed in the vicinity of the detection section. The transmission portion transmits a swing of the swing portion to the operation portion. The detection section detects whether or not paper is present in the fixing nip region through detection as to whether or not the operation portion swings.

SUMMARY

A fixing device according to a first aspect of the present disclosure includes a casing, a fixing roller, a pressure roller, a heat source, a sensor, and a duct. The fixing roller is disposed in the casing. The pressure roller forms a fixing nip region in cooperation with the fixing roller. The heat source heats the fixing roller. The sensor detects whether or not a recording medium is present in the fixing nip region. The duct is disposed on the casing. One end part of opposite end parts of the heat source protrudes out of the casing. The duct covers the one end part of the heat source and exhausts heat generated from the one end part of the heat source in a direction away from the sensor.

An image forming apparatus according to a second aspect of the present disclosure includes an image forming section and a fixing section. The image forming section forms a toner image on a recording medium. The fixing section fixes the toner image to the recording medium. The fixing section corresponds to the above fixing device.

DETAILED DESCRIPTION

Figure 1:
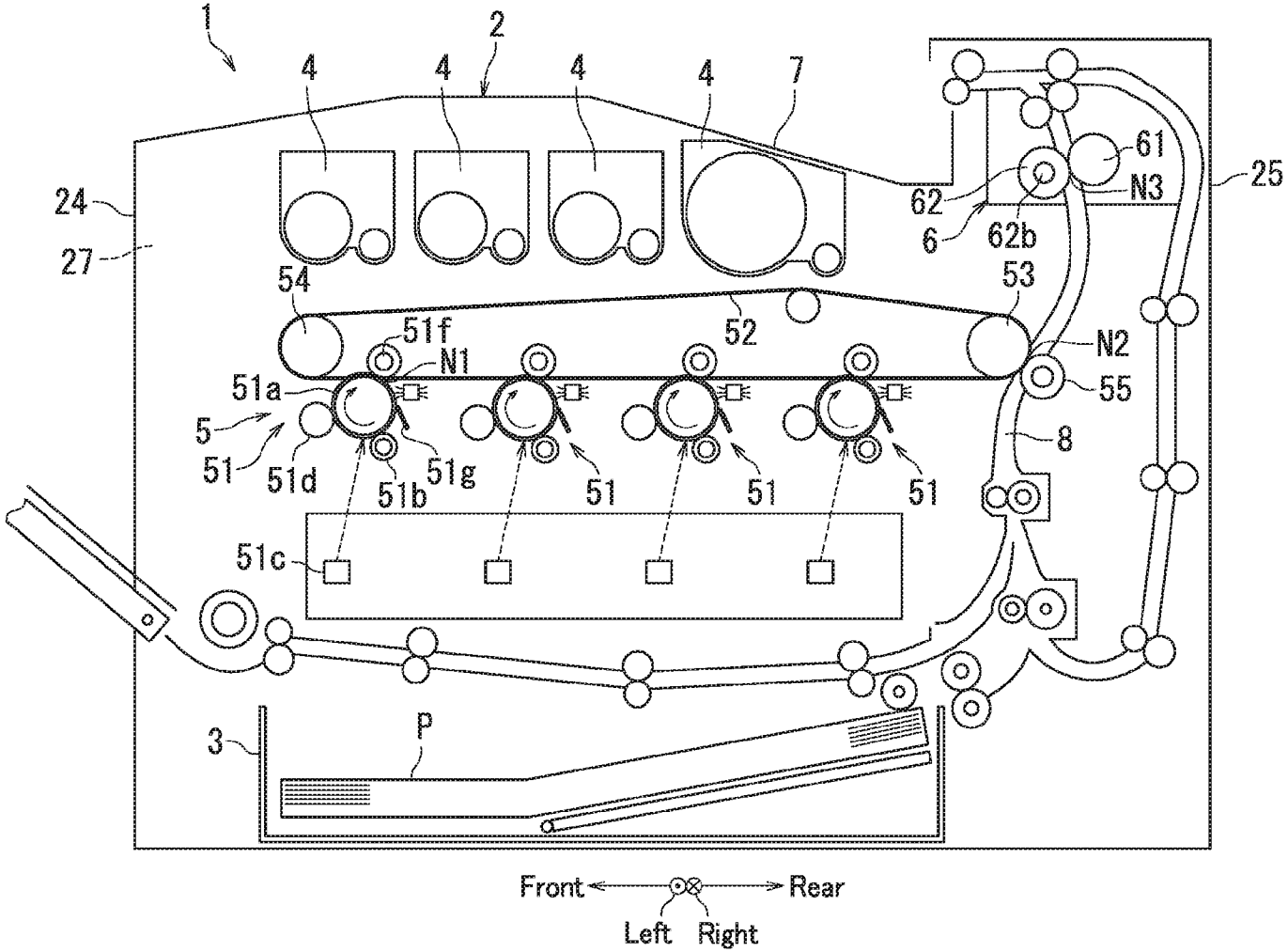
FIG. 1 illustrates a configuration of an image forming apparatus according to an embodiment of the present disclosure.

Following describes an embodiment of the present disclosure with reference to accompanying drawings. Note that elements that are the same or equivalent are indicated by the same reference signs in the drawings and explanation thereof is not repeated.

An image forming apparatus according to the embodiment of the present embodiment will be described with reference to FIG. 1. FIG. 1 illustrates a configuration of an image forming apparatus 1 according to the embodiment of the present disclosure.

As illustrated in FIG. 1, the image forming apparatus 1 according to the embodiment of the present disclosure forms a toner image on a sheet P (recording medium). As a result, an image is formed on the sheet P. The image forming apparatus 1 includes a casing 2, a sheet feed cassette 3, a plurality of toner containers 4, an image forming section 5, a fixing section 6 (fixing device), an exit tray 7, and a sheet conveyance path 8.

The casing 2 accommodates respective elements of the image forming apparatus 1 (i.e., the sheet feed cassette 3, the toner containers 4, the image forming section 5, the fixing section 6, and the sheet conveyance path 8).

The sheet feed cassette 3 supplies a sheet P to the image forming section 5. A plurality of sheets P are stacked and loaded in the sheet feed cassette 3. The sheets P in the sheet feed cassette 3 are fed one at a time and supplied to the image forming section 5 through the sheet conveyance path 8.

The toner containers 4 each are a container of a color toner (for example, a cyan toner, a magenta toner, a yellow toner, or a black toner). The toner containers 4 supply the respective color toners to the image forming section 5.

The image forming section 5 forms an image on the sheet P supplied from the sheet feed cassette 3 with the color toners supplied from the respective toner containers 4. The image forming section 5 includes a plurality of image forming units 51, an intermediate transfer belt 52, a drive roller 53, a driven roller 54, and a secondary transfer roller 55.

The image forming units 51 are each provided for corresponding one of the toner containers 4. The image forming units 51 receive supply of the color toners from the corresponding toner containers 4. The image forming units 51 form toner images in the respective colors on a surface of the intermediate transfer belt 52 based on image information.

The toner images in the respective colors are superimposed. Through the above, a full color toner image is formed on the surface of the intermediate transfer belt 52.

The image forming units 51 each include a photosensitive drum 51*a*, a charger 51*b*, an exposure device 51*c*, a developing device 51*d*, a primary transfer roller 51*f*, and a cleaner 51*g*.

The photosensitive drum 51*a* includes a photosensitive layer on a surface thereof. The charger 51*b* uniformly charges the surface of the photosensitive drum 51*a* to a specific potential. The exposure device 51*c* irradiates the charged surface of the photosensitive drum 51*a* with laser light. Through irradiation, the exposure device 51*c* forms an electrostatic latent image corresponding to the image information on the surface of the photosensitive drum 51*a*. The developing device 51*d* develops the electrostatic latent image on the surface of the photosensitive drum 51*a* into a toner image with toner supplied from a corresponding one of the toner containers 4.

The primary transfer roller 51*f* transfers the toner image on the surface of the photosensitive drum 51*a* to the surface of the intermediate transfer belt 52. The primary transfer roller 51*f* forms a primary transfer nip region N1 in cooperation with the photosensitive drum 51*a* with the intermediate transfer belt 52 therebetween. Primary transfer voltage is applied to the surface of the primary transfer roller 51*f*. In the above configuration, as the toner image on the surface of the photosensitive drum 51*a* passes through the primary transfer nip region N1, the toner image is transferred to the intermediate transfer belt 52 by electrostatic attraction of the primary transfer roller 51*f*. The cleaner 51*g* removes residual toner on the surface of the photosensitive drum 51*a* after transfer.

The intermediate transfer belt 52 conveys the color toner image on the surface thereof to the secondary transfer roller 55. The intermediate transfer belt 52 is an endless belt. The intermediate transfer belt 52 is wound between the drive roller 53 and the driven roller 54. The intermediate transfer belt 52 is circulated through rotational drive by the drive roller 53. Through circulation of the intermediate transfer belt 52, the toner image on the surface of the intermediate transfer belt 52 is conveyed to the secondary transfer roller 55.

The secondary transfer roller 55 transfers the toner image on the surface of the intermediate transfer belt 52 to the sheet P. The secondary transfer roller 55 forms a secondary transfer nip region N2 in cooperation with the drive roller 53 with the intermediate transfer belt 52 therebetween. Secondary transfer voltage is applied to the secondary transfer roller 55. In the above configuration, as the color toner image on the surface of the intermediate transfer belt 52 passes through the secondary transfer nip region N2 together with the sheet P, the toner image is transferred to the sheet P by electrostatic attraction of the secondary transfer roller 55. The sheet P to which the toner image has been transferred is conveyed to the fixing section 6 through the sheet conveyance path 8. The fixing section 6 fixes to the sheet P the toner image transferred to the sheet P. The fixing section 6 includes a pressure roller 61 and a fixing roller 62. The fixing roller 62 includes a heat source 62*b*. The heat source 62*b* applies heat to the sheet P. A fixing nip region N3 is formed between the pressure roller 61 and the fixing roller 62. As the sheet P to which the toner image has been transferred passes through the fixing nip region N3, the toner image is fixed to the sheet P though pressure by the pressure roller 61 and heat by the fixing roller 62. The sheet P to which the toner image has been fixed is ejected onto the exit tray 7.

The exit tray 7 is located on top of the casing 2, for example.

The sheet conveyance path 8 extends from the sheet feed cassette 3 to the exit tray 7 via the secondary transfer nip region N2 and the fixing nip region N3 in the stated order.

Note that the casing 2 is a box having a rectangular parallelepiped shape, for example. The casing 2 has a front surface 24, a rear surface 25, a left surface (near side in the drawing, not illustrated), and a right surface (far side in the drawing) 27. Here, front, rear, left, and right of the image forming apparatus 1 correspond to the front surface 24, the rear surface 25, the left surface, and the right surface 27 of the casing 2, respectively.

Figure 2:
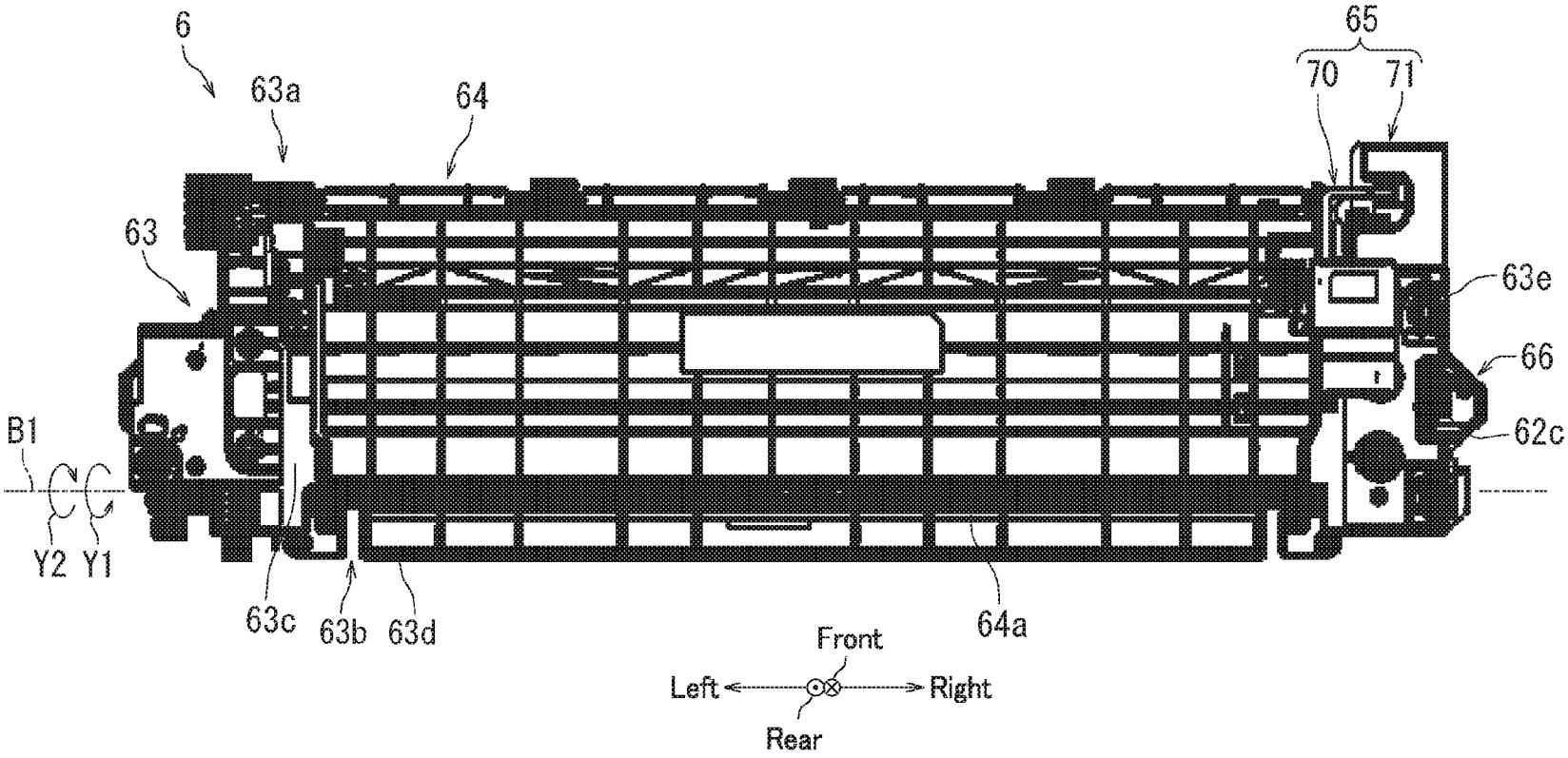
FIG. 2 is a rear view illustrating a fixing section.

The fixing section 6 will be described below with reference to FIGS. 2-6. FIG. 2 is a rear view of the fixing section 6 as viewed from the rear.

As illustrated in FIG. 2, the fixing section 6 includes a fixing section main body 63, a fixing section cover 64, an intra-fixing section jam sensor 65 (sensor), and a duct 66.

The fixing section main body 63 accommodates the pressure roller 61 and the fixing roller 62. The fixing section main body 63 is an oblong box having a rectangular parallelepiped shape extending in a left-right direction of the image forming apparatus 1, for example. An upper surface 63*a* and a lower surface 63*b* of the fixing section main body 63 are open (see an upper opening 74*a* and a lower opening 74*b* in FIG. 5). A right side surface 63*e* of the fixing section main body 63 has a bearing hole (not illustrated, through hole). One end part 62*c* of opposite end parts of the heat source 62*b* protrudes out of the fixing section main body 63 from the bearing hole.

The fixing section cover 64 covers the upper and rear surfaces 63*a* and 63*c* of the fixing section main body 63 in an openable and closable manner. The fixing section cover 64 is disposed over the fixing section main body 63 in an openable and closable manner. A lower end part 64*a* of the fixing section cover 64 is supported at a lower end part 63*d* of the rear surface 63*c* in a pivotal manner about a pivot axis B1. The pivot axis B1 extends in a width direction of the rear surface 63*c* (i.e., the left-right direction of the image forming apparatus 1).

When the fixing section cover 64 is turned about the pivot axis B1 in an arrow direction Y1, the upper and rear surfaces 63*a* and 63*c* of the fixing section main body 63 are open. In a situation as above, an interior of the fixing section main body 63 is exposed through the upper surface 63*a*. In the above configuration, a jam in the fixing section main body 63 can be cleared. In order that the fixing section cover 64 closes the fixing section main body 63, the fixing section cover 64 is turned about the pivot axis B1 in an arrow direction Y2.

The intra-fixing section jam sensor 65 detects whether or not a sheet P is present in the fixing nip region N3. The intra-fixing section jam sensor 65 includes a swing mechanism 70 and a detection section 71. The swing mechanism 70 is caused to swing by a sheet P passing through the fixing nip region N3. The detection section 71 detects whether or not a sheet P is present in the fixing nip region N3 through detection as to whether or not the swing mechanism 70 swings. The detection section 71 is disposed above the fixing section main body 63. Specifically, the detection section 71 is disposed above the side surface 63*e* of the fixing section main body 63.

The duct 66 prevents conduction of heat generated from the one end part 62*c* of the heat source 62*b* to the detection section 71. The one end part 62*c* protrudes out of the fixing section main body 63 through the side surface 63*e* thereof.

The duct 66 is disposed on the side surface 63*e* so as to cover the one end part 62*c* of the heat source 62*b*.

Figure 3:
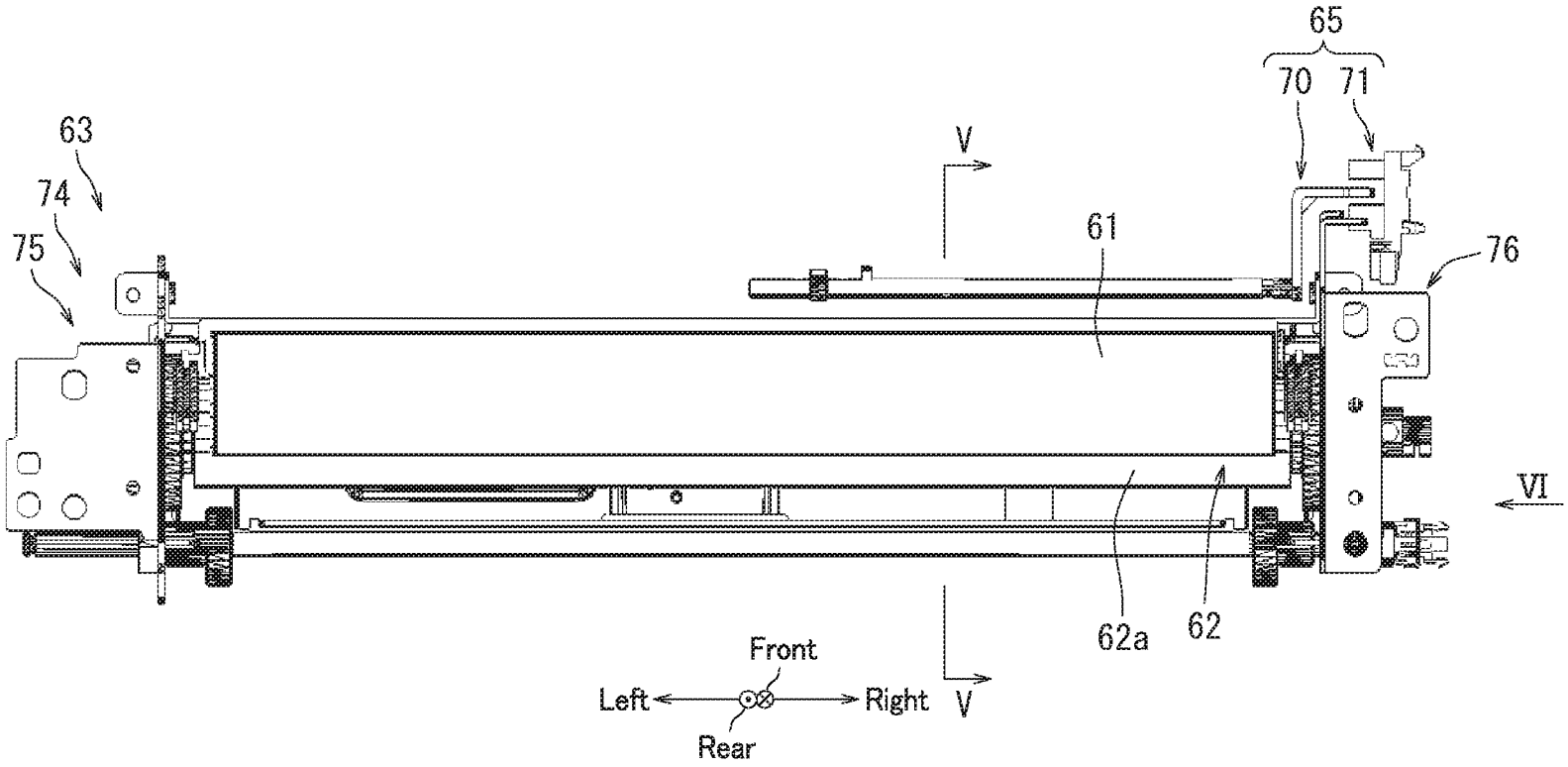
FIG. 3 is a rear view illustrating a fixing section main body.
Figure 4:
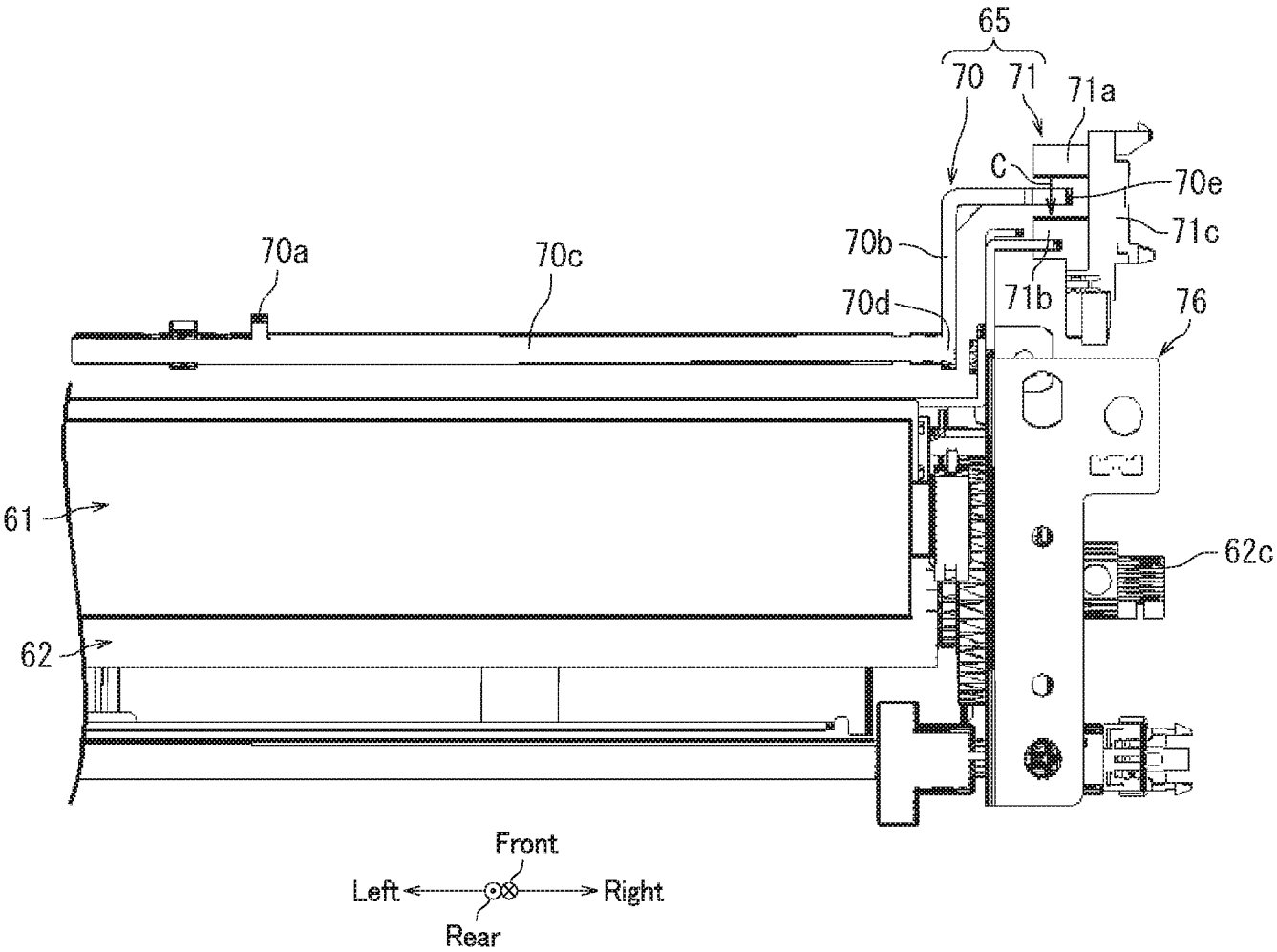
FIG. 4 is an enlarged view illustrating a right end part of the fixing section main body illustrated in FIG. 3.

FIG. 3 is a rear view of the fixing section main body 63 as viewed from the rear. FIG. 4 is an enlarged view illustrating a right end part of the fixing section main body 63 illustrated in FIG. 3.

As illustrated in FIG. 3, the fixing section main body 63 includes the pressure roller 61, the fixing roller 62, and a casing 74. The casing 74 accommodates the pressure roller 61 and the fixing roller 62. The casing 74 is a box having a rectangular parallelepiped shape, for example. The casing 74 includes a left wall 75 and a right wall 76 (side walls). The left wall 75 supports each left end part of the pressure roller 61 and the fixing roller 62 in a rotatable manner. The right wall 76 supports each right end part of the pressure roller 61 and the fixing roller 62 in a rotatable manner.

As illustrated in FIG. 4, the swing mechanism 70 includes a swing portion 70*a*, an operation portion 70*b*, and a pivot shaft 70*c*.

Figure 5:
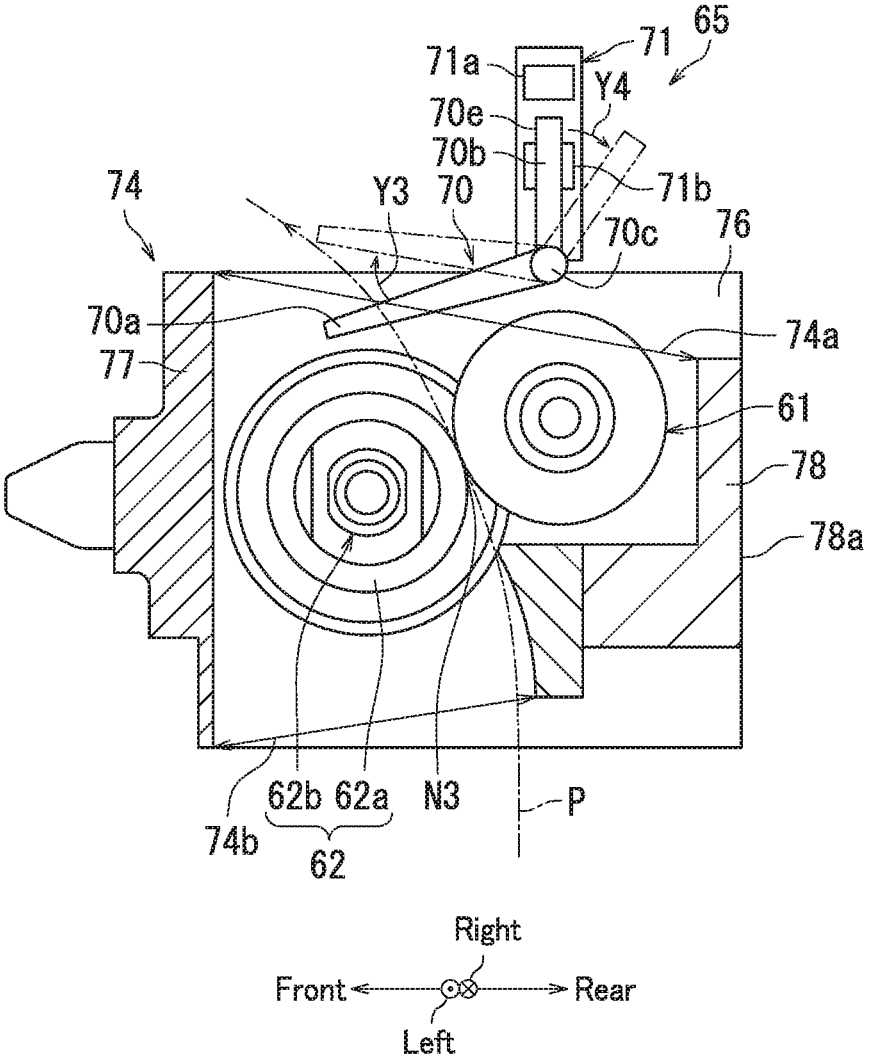
FIG. 5 is a cross sectional view taken along a line V-V in FIG. 3.

The swing portion 70*a* is caused to swing by a sheet P passing through the fixing nip region N3 (see FIG. 5). The swing portion 70*a* has a bar-like shape, for example. The swing portion 70*a* extends in radial direction of the pivot shaft 70*c* from the pivot shaft 70*c*. The swing portion 70*a* is swingable about the pivot shaft 70*c*.

The pivot shaft 70*c* transmits the swing of the swing portion 70*a* to the operation portion 70*b*. The pivot shaft 70*c* is located above for example the pressure roller 61 in parallel to the pressure roller 61. The pivot shaft 70*c* is supported on the fixing section 6 in a pivotal manner. Specifically, the pivot shaft 70*c* is supported on the casing 74 (for example, the right wall 76) or the fixing section cover 64 in a pivotal manner.

The operation portion 70*b* transmits the swing of the swing portion 70*a* to the detection section 71. The operation portion 70*b* has a bar-like shape, for example. The operation portion 70*b* is located at a right end 70*d* of the pivot shaft 70*c*. The operation portion 70*b* extends from the pivot shaft 70*c* in a radial direction of the pivot shaft 70*c*. The operation portion 70*b* extends upward from the pivot shaft 70*c*. The operation portion 70*b* has a tip end part 70*e* bent toward the detection section 71 (that is, rightward). The operation portion 70*b* is swingable about the pivot shaft 70*c*.

The detection section 71 detects a swing of the operation portion 70*b*. The detection section 71 detects whether or not a sheet P is present in the fixing nip region N3 through detection of the swing of the operation portion 70*b*. The detection section 71 is located above the casing 74. Specifically, the detection section 71 is located above the right wall 76.

The detection section 71 includes a light emitting portion 71*a*, a light receiving portion 71*b*, and a support portion 71*c*. The support portion 71*c* is located above the right wall 76. The light emitting portion 71*a* and the light receiving portion 71*b* are disposed on a left side surface of the support portion 71*c* with a space therebetween in a vertical direction. The light emitting portion 71*a* emits light C toward the light receiving portion 71*b*. The light receiving portion 71*b* receives the light C. The tip end part 70*e* of the operation portion 70*b* is located between the light emitting portion 71*a* and the light receiving portion 71*b*.

FIG. 5 is a cross sectional view taken along a line V-V in FIG. 3.

As illustrated in FIG. 5, the casing 74 includes a front wall 77 and a rear wall 78 in addition to the right and left walls 76 and 75. Note that the rear wall 78 is not illustrated in FIGS. 3 and 4 for the sake of illustration convenience. The front wall 77 is disposed in front of the fixing roller 62. The front and rear walls 77 and 78 connect the right and left walls 76 and 75. The rear wall 78 is disposed in the rear of the pressure roller 61.

The casing 74 has an upper opening 74*a* and a lower opening 74*b*. The upper opening 74*a* constitutes the upper surface 63*a* of the fixing section main body 63. The lower opening 74*b* constitutes the lower surface 63*b* of the fixing section main body 63. A rear surface 78*a* of the rear wall 78 constitutes the rear surface 63*c* of the fixing section main body 63. An outer surface 76*b* of the right wall 76 (see FIG. 6) constitutes the side surface 63*e* of the fixing section main body 63.

The pressure roller 61 and the fixing roller 62 are disposed in the casing 74 in a rotatable manner, as described above. The fixing roller 62 is disposed for example in front of and obliquely below the pressure roller 61. The fixing roller 62 forms the fixing nip region N3 in cooperation with the pressure roller 61. The pressure roller 61 has a cylindrical shape. The fixing roller 62 includes a cylinder portion 62*a* and the heat source 62*b*. Opposite end parts of the cylinder portion 62*a* are open. The heat source 62*b* applies heat to the cylinder portion 62*a*. The heat source 62*b* is a bar-shaped halogen or xenon lamp. The heat source 62*b* is disposed in the cylinder portion 62*a* in a longitudinal direction of the cylinder portion 62*a*.

The sheet P conveyed from the image forming section 5 is conveyed into the casing 74 through the lower opening 74*b*. The conveyed sheet P passes through the fixing nip region N3. During the sheet P passing therethrough, the toner image on the sheet P is fixed through pressure by the pressure roller 61 and heat by the fixing roller 62. The sheet P having passed through the fixing nip region N3 is ejected out of the casing 74 from between the upper opening 74*a* of the casing 74 and a fixing section cover 64 (see FIG. 2, not illustrated in FIG. 5).

The swing portion 70*a* is located in the vicinity of the upper opening 74*a* of the casing 74. A tip end of the swing portion 70*a* is located downstream of the fixing nip region N3 in terms of a conveyance direction of the sheet P. That is, the tip end of the swing portion 70*a* is located in the vicinity of an exit of the fixing nip region N3.

During passing through the fixing nip region N3, the sheet P swings the swing portion 70*a* about the pivot shaft 70*c* in an arrow direction Y3 in the intra-fixing section jam sensor 65. In the above configuration, the operation portion 70*b* swings about the pivot shaft 70*c* in an arrow direction Y4 to move the tip end part 70*e* away from the space between the light emitting portion 71*a* and the light receiving portion 71*b*. As a result, the light receiving portion 71*b* receives light from the light emitting portion 71*a*. Through light receipt, the detection section 71 detects the swing of the operation portion 70*b*. In other words, a sheet P is present in the fixing nip region N3 during the detection section 71 detecting a swing of the operation portion 70*b*.

By contrast, once the sheet P is ejected from the fixing nip region N3, the swing portion 70*a* returns to an original position (that is, a position before being swung) with a result that the tip end part 70*e* is located between the light emitting portion 71*a* and the light receiving portion 71*b*. In a situation as above, the tip end part 70*e* blocks light emitted from the light emitting portion 71*a* so that the light receiving portion 71*b* does not receive light from the light emitting portion 71*a*. As a result, the detection section 71 accordingly does not detect a swing of the operation portion 70*b*. In other words, no sheet P is present in the fixing nip region N3 during the detection section 71 not detecting a swing of the operation portion 70*b*.

Figure 6:
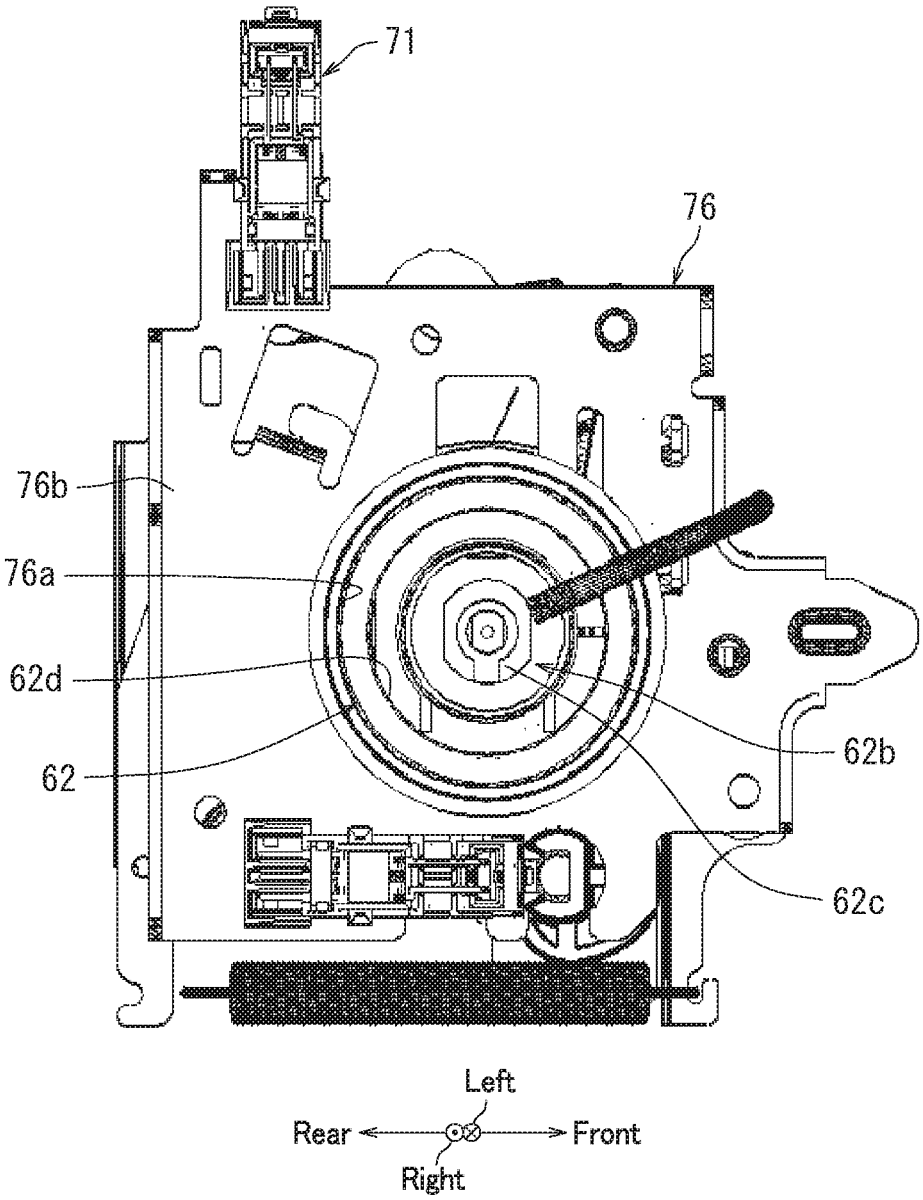
FIG. 6 is a side view of a right side surface of the fixing section main body as viewed in an arrow direction VI in FIG. 3.

FIG. 6 is a side view of the right side surface 63*e* of the fixing section main body 63 as viewed in an arrow direction VI in FIG. 3.

As illustrated in FIG. 6, the right wall 76 has the bearing hole 76*a* (through hole). The bearing hole 76*a* supports a right open end part 62*d* of the fixing roller 62 in a rotatable manner. The right open end part 62*d* is one of the opposite open end parts of the cylinder portion 62*a*. The right open end part 62*d* is exposed on a side of the outer surface 76*b* of the right wall 76 through the bearing hole 76*a*. The one end part 62*c* of the heat source 62*b* protrudes out of the right open end part 62*d* of the fixing roller 62. The one end part 62*c* further protrudes out of the outer surface 76*b* from the bearing hole 76*a*.

Figure 7:
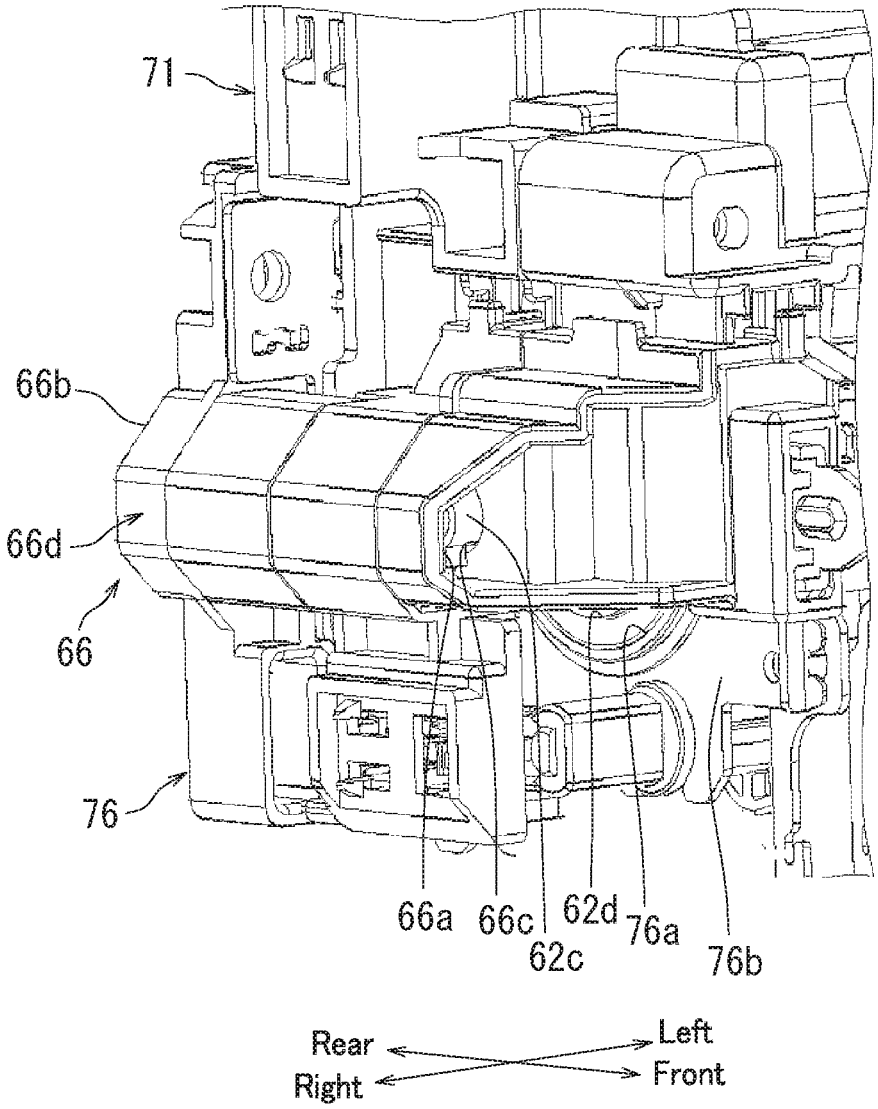
FIG. 7 is a perspective view illustrating the right side surface of the fixing section main body in a situation in which a duct is disposed.
Figure 8:
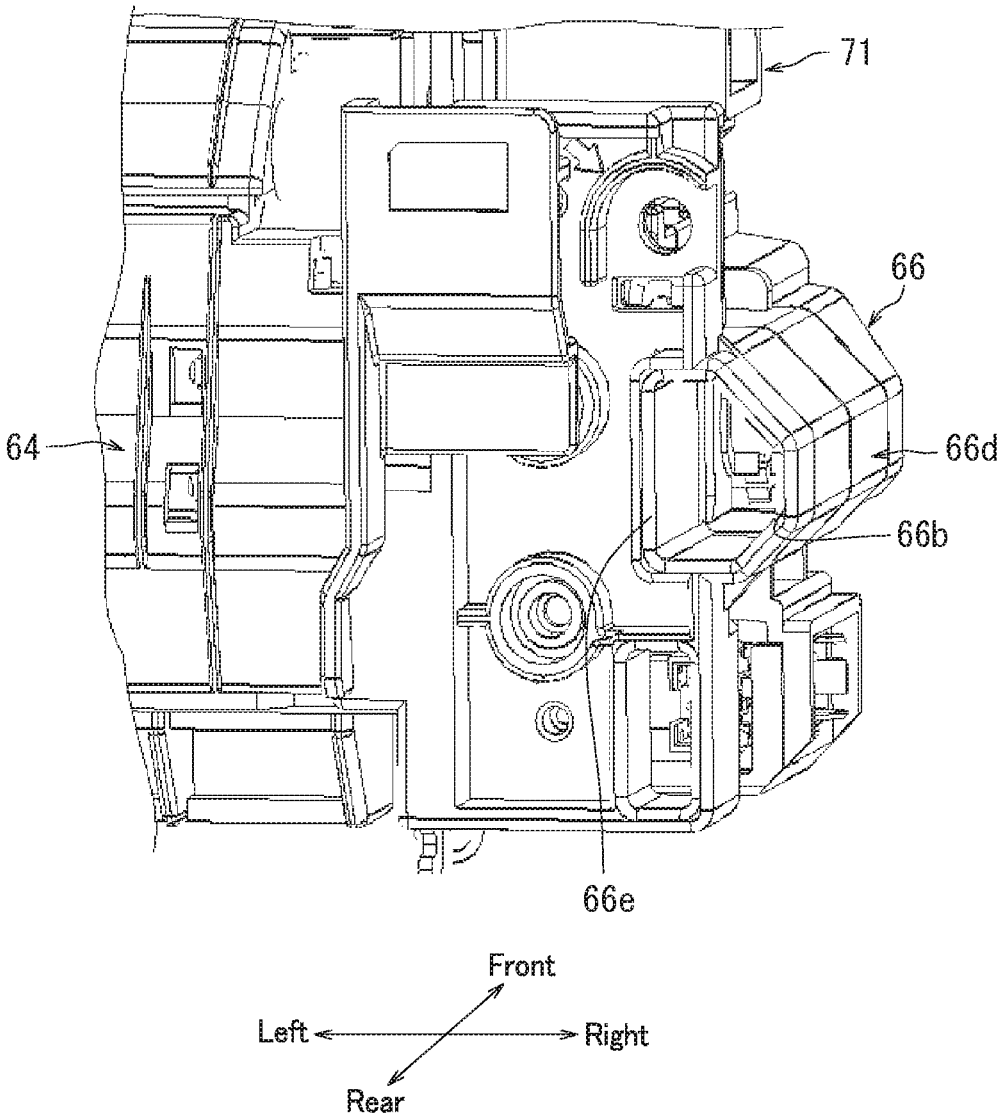
FIG. 8 is another perspective view illustrating the right side surface of the fixing section main body in the situation in which the duct is disposed.
Figure 9:
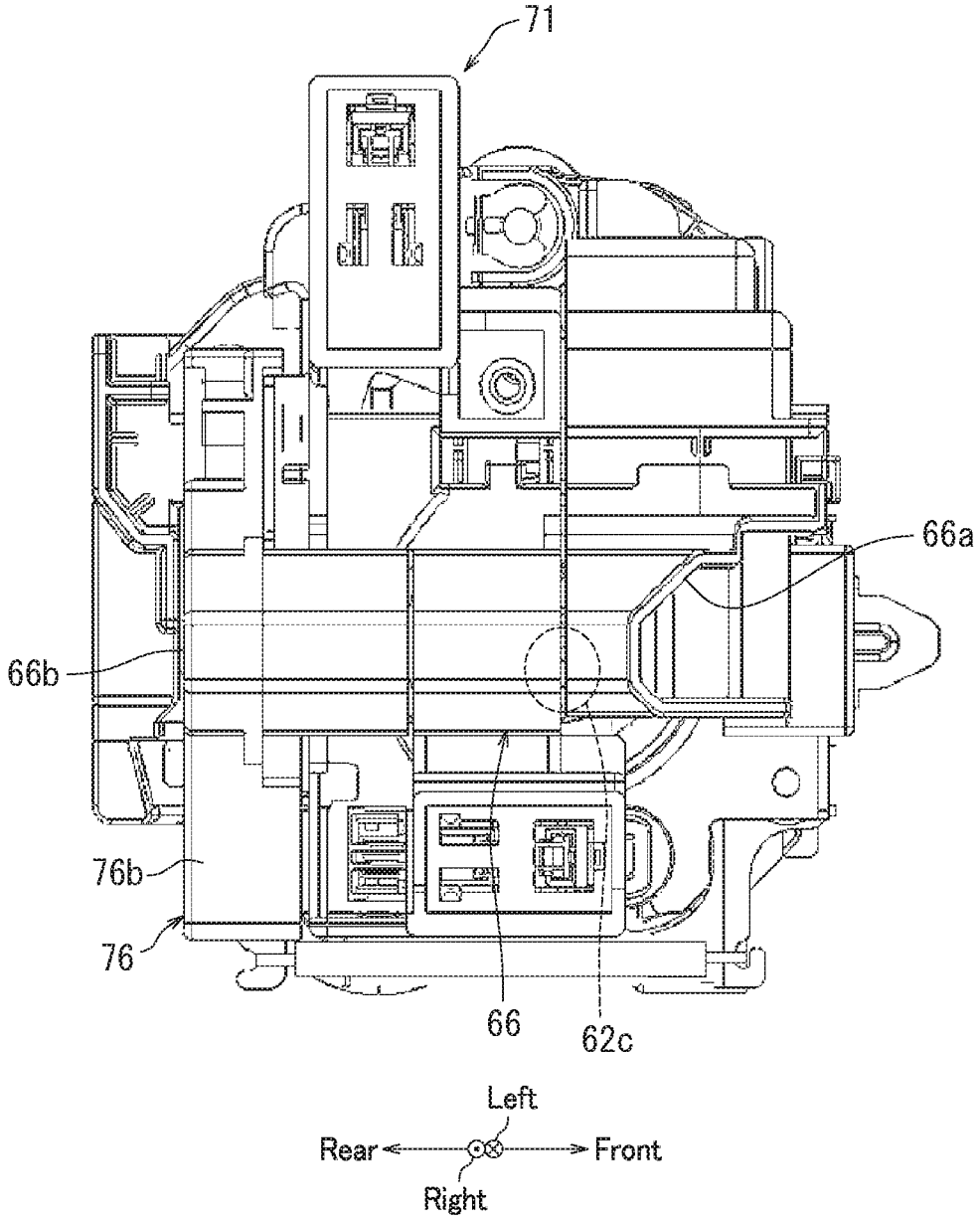
FIG. 9 is a side view illustrating the right side surface of the fixing section main body in the situation in which the duct is disposed.

The duct 66 will be described next with reference to FIGS. 7-9. FIG. 7 is a perspective view illustrating the right side surface 63*e* of the fixing section main body 63 in a situation in which the duct 66 is disposed. FIG. 8 is another perspective view illustrating the right side surface 63*e* of the fixing section main body 63 in the situation in which the duct 66 is disposed. FIG. 9 is a side view illustrating the right side surface 63*e* of the fixing section main body 63 in the situation in which the duct 66 is disposed.

As illustrated in FIG. 7, the duct 66 is disposed on the outer surface 76*b* of the right wall 76. The duct 66 covers the one end part 62*c* of the heat source 62*b*. The duct 66 exhausts heat generated from the one end part 62*c* in a direction away from the intra-fixing section jam sensor 65 (especially, the detection section 71).

The duct 66 has a cylindrical shape trapezoidal in section, for example. Opposite ends 66*a* and 66*b* of the duct 66 are open. An outer circumferential surface 66*d* of the duct 66 has an insertion port 66*c*. The insertion port 66*c* is an opening through which the one end part 62*c* of the heat source 62*b* is inserted into the duct 66. The insertion port 66*c* is located in a surface portion 66*e* (base surface portion, see FIG. 8) of the outer circumferential surface 66*d* that corresponds to a base of the sectional shape (i.e., trapezoidal shape) of the duct 66.

The duct 66 is disposed beside the outer surface 76*b* of the right wall 76 such that the one end part 62*c* protruding through the insertion port 66*c* is housed in the duct 66. That is, the duct 66 is disposed on the outer surface 76*b* such that the surface portion 66*e* of the outer circumferential surface 66*d* of the duct 66 faces the outer surface 76*b*.

As illustrated in FIG. 9, the detection section 71 is located above the duct 66. The duct 66 extends in a horizontal direction (for example, a front-rear direction of the image forming apparatus 1) on the outer surface 76*b* of the right wall 76. A front one 66*a* of the opposite open ends 66*a* and 66*b* of the duct 66 is located frontward of the detection section 71 (that is, on one side in the horizontal direction). A rear open end 66*b* that is the other of the opposite open ends 66*a* and 66*b* of the duct 66 is located rearward of the detection section 71 (that is, on the other side in the horizontal direction).

Heat generated from the one end part 62*c* of the heat source 62*b* is induced in the front-rear direction through the duct 66. In the above configuration, a situation in which heat generated from the one end part 62*c* is conducted upward of the one end part 62*c* (that is, toward the detection section 71) can be prevented. As a result, a situation in which the temperature around the detection section 71 exceeds temperature below which the detection section 71 is operable can be prevented. The heat induced through the duct 66 is released out from the opposite open ends 66*a* and 66*b* of the duct 66. In the above configuration, a situation in which heat accumulates in the duct 66 can be prevented.

Furthermore, the opposite open ends 66*a* and 66*b* face in the front-rear direction (i.e., the horizontal direction). That is, the opposite open ends 66*a* and 66*b* do not face downward. In the above configuration, heat in the duct 66 can be released easily. Moreover, the opposite open ends 66*a* and 66*b* do not face upward. In the above configuration, a situation in which heat exhausted from the duct 66 is conducted toward the detection section 71 can be prevented.

In a configuration as described above in which the image forming apparatus 1 includes the duct 66, the detection section 71 can be disposed on the fixing section main body 63 (specifically, above the right wall 76) without being affected by heat generated from the one end part 62*c* of the heat source 62*b*. As a result, the swing mechanism 70 can be compacted when compared with a configuration in which the detection section 71 is disposed outside the fixing section 6. As a result, the number of components of the swing mechanism 70 can be reduced and the swing mechanism 70 can be reduced in size.

The embodiment of the present disclosure has been described so far with reference to the drawings (FIGS. 1-9). However, the present disclosure is not limited to the above embodiments and may be implemented in various different forms that do not deviate from the essence of the present disclosure (for example, as described below in section (1)). The drawings schematically illustrate elements of configuration in order to facilitate understanding. Properties of the elements of configuration illustrated in the drawings, such as thickness, length, and quantity, may differ from reality in order to aid preparation of the drawings. Properties of the elements of configuration in the above embodiments, such as material, shape, and dimension, are merely examples that do not impose any particular limitations and can be altered in various ways to the extent that there is not substantial deviation from the effects of the present disclosure.

(1) The shape of the duct 66 in the above embodiment is an example. For example, a direction in which the duct 66 extends is not limited to the front-rear direction. Furthermore, the duct 66 is not limited to extending within a range of the outer surface 76*b* and may extend beyond the outer surface 76*b*. The number of the open ends of the duct 66 is not limited to two.

What is claimed is:

1. A fixing device comprising:

a casing;

a fixing roller disposed in the casing;

a pressure roller that forms a fixing nip region in cooperation with the fixing roller;

a heat source configured to heat the fixing roller;

a sensor configured to detect whether or not a recording medium is present in the fixing nip region; and a duct disposed on the casing, wherein one end part of opposite end parts of the heat source protrudes out of the casing, the duct covers the one end part of the heat source and exhausts heat generated from the one end part of the heat source in a direction away from the sensor.

2. The fixing device according to claim 1, wherein the sensor includes:

a swing mechanism that is caused to swing through the recording medium passing through the fixing nip region, and a detection section that detects whether or not the swing mechanism swings.

3. The fixing device according to claim 2, wherein the detection section is disposed above the duct, and the duct extends substantially in a horizontal direction on an outer surface of the casing.

4. The fixing device according to claim 3, wherein the duct is a cylinder having opposite open ends, and one of the opposite open ends of the duct is located on one side of the detection section in the horizontal direction, and the other of the opposite open ends of the duct is located on the other side of the detection section in the horizontal direction.

5. The fixing device according to claim 2, wherein the casing has a side wall having a through hole, the detection section is disposed above the side wall, and the one end part of the heat source protrudes out of the side wall through the through hole.

6. The fixing device according to claim 5, wherein the fixing roller has a cylindrical shape having an open end part, the through hole in the side wall supports the open end part in a rotatable manner, the heat source is disposed in the fixing roller, and the one end part of the heat source protrudes out of the open end part and protrudes out of the side wall from the through hole.

7. The fixing device according to claim 2, wherein the swing mechanism includes a swing portion and an operation portion, the swing portion being caused to swing through the recording medium passing through the fixing nip region, the operation portion transmitting a swing of the swing portion to the detection section, the detection section includes a light emitting portion that emits light and a light receiving portion that receives the light, the light emitting portion and the light receiving portion are spaced apart from each other, and the operation portion blocks light from the light emitting portion to the light receiving portion in a situation in which the swing portion does not swing, and the operation portion does not block light from the light emitting portion to the light receiving portion in a situation in which the swing portion swings.

8. The fixing device according to claim 1, wherein the duct has a cylindrical shape and has an outer circumferential surface having an insertion port, and the duct is disposed on an outer surface of the casing such that the one end part of the heat source is inserted into the duct through the insertion port.

9. The fixing device according to claim 1, wherein the duct is a cylinder having a substantially trapezoidal shape in section, the duct has an outer circumferential surface including a base surface portion corresponding to a base of the trapezoidal shape in section, and the duct is disposed on the casing such that the base surface portion faces an outer surface of the casing.

10. The fixing device according to claim 1, wherein the casing has an oblong box shape, the one end part of the heat source protrudes out of the casing from one of side surfaces of the casing in a longitudinal direction thereof, and the duct is disposed on the side surface of the casing.

11. An image forming apparatus comprising:

an image forming section configured to form a toner image on a recording medium; and a fixing section configured to fix the toner image to the recording medium, wherein the fixing section corresponds to the fixing device according to claim 1.

* * * * *